United States Patent [19]

Quayle

[11] 4,289,154

[45] Sep. 15, 1981

[54] SELF-CLEANING FLOAT MECHANISM

[75] Inventor: Lawrence L. Quayle, Lambs Grove, Iowa

[73] Assignee: The Maytag Company, Newton, Iowa

[21] Appl. No.: 98,601

[22] Filed: Nov. 29, 1979

[51] Int. Cl.[3] ..... B08B 3/02

[52] U.S. Cl. ..... 134/56 D; 134/183; 73/322.5; 137/387; 200/84 R

[58] Field of Search ..... 134/56 R, 56 D, 57 R, 134/57 D, 57 DL, 182, 183; 73/322.5; 200/84 R; 137/387, 412

[56] References Cited

U.S. PATENT DOCUMENTS

| | | | |
|---|---|---|---|
| 3,464,437 | 9/1969 | Zane | 137/387 |
| 3,610,271 | 10/1971 | Jarvis | 137/412 |
| 3,721,783 | 3/1973 | Hancock | 134/56 D X |
| 3,829,636 | 8/1974 | Scott | 134/57 D X |
| 3,885,580 | 5/1975 | Cushing | 134/57 D |
| 3,894,555 | 7/1975 | Payne | 137/412 |

FOREIGN PATENT DOCUMENTS

| | | | |
|---|---|---|---|
| 54-123265 | 9/1979 | Japan | 134/57 D |

*Primary Examiner*—Robert L. Bleutge
*Attorney, Agent, or Firm*—Richard L. Ward

[57] ABSTRACT

A dishwashing apparatus is provided with a float controlled liquid inlet valve. The float includes a centrally located, downwardly extending, stem portion which extends through the inner aperture of a standpipe associated with the bottom wall of the liquid container. A cap portion of the float surrounds and encloses the upper extremity of the standpipe and prevents spraying liquid from escaping the liquid container through the standpipe aperture. A floatation chamber is axially spaced below the cap portion of the float and is connected thereto by a plurality of arms. The spacing of the float chamber from the cap defines openings which allow liquid to wash through the inner section of the float and around the standpipe to remove debris.

9 Claims, 4 Drawing Figures

SELF-CLEANING FLOAT MECHANISM

BACKGROUND OF THE INVENTION

Prior art float members used in dishwasher applications have been generally of a design which permits an area of reduced liquid flow in the vicinity of the float interior and outside surface of the standpipe. Because of the reduced liquid flow, particles of food and detergent scum tend to be trapped and to build up on the inside of the float and on the outside of the standpipe. After prolonged operation, the build-up may become sufficient to hinder vertical movement of the float upon the standpipe.

One particular prior art float device includes partitions providing a plurality of chambers with a portion of the chambers devoted to floatation and the remainer of the chambers providing a dashpot effect as well as providing a vent from the standpipe through the center post and the upper wall of the float to provide a siphon break. This float does not provide an access for liquid flow to clean its interior portions.

Another prior art float device is directed to a construction having a generally hat-shaped profile and including a radially enlarged relatively shallow float chamber formed at the base of the float for achieving improved stability. Again, there is no provision for utilizing the flow of liquid to cleanse the float interior.

SUMMARY OF THE INVENTION

It is therefore an object of the instant invention to provide an improved float construction for a dishwashing apparatus.

It is a further object of the instant invention to provide a self-cleaning float construction which will permit the cleansing flow of liquid into the inner portions of the float.

It is a still further object of the instant invention to provide a self-cleaning float mechanism which prevents the accumulation of debris in the vicinity of the float.

Briefly, the instant invention achieves these objects in a liquid level control device for a washing apparatus having a liquid container including a bottom wall and mechanism within the container for spraying liquid. A standpipe extends generally vertically from the bottom wall and has an open upper end disposed above the liquid operating level and a lower end providing an opening through the bottom wall. A liquid supply control outside the container includes an actuating lever adjacent the lower end of the standpipe. A vertically movable control member is operably associated with the standpipe and includes a buoyant portion radially spaced from the standpipe. A cap portion of the control member is axially spaced above the buoyant portion and encloses the open upper end of the standpipe to prevent entry of spraying liquid thereinto. Members are provided for interconnecting the buoyant portion and the cap portion in the axially spaced apart relationship and define an open area therebetween to permit liquid to flow therethrough. An elongated stem portion extends downwardly from the cap portion and through the standpipe for engagement with the actuating means.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
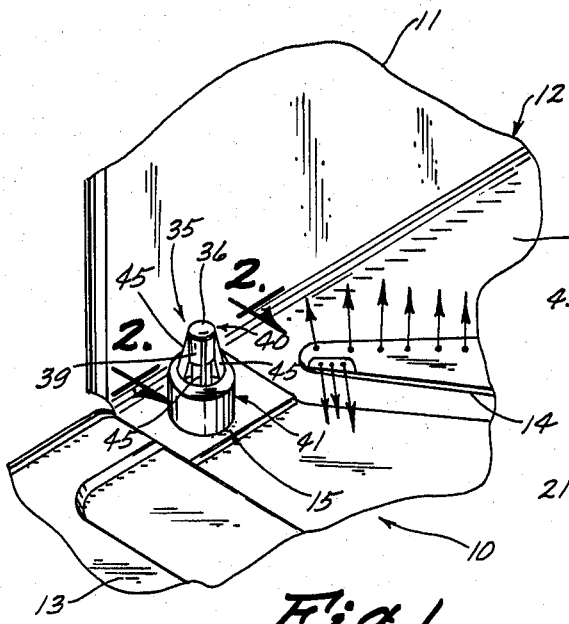
FIG. 1 is a fragmentary perspective view of the front of a dishwashing apparatus showing the general location of a float controlled liquid level control mechanism.

There is shown generally in FIG. 1 a dishwashing apparatus 10. The dishwashing apparatus 10 includes a tub 11 forming a liquid container or washing chamber 12 and a door 13 for providing access to the washing chamber 12. Further shown in FIG. 1 is one of a plurality of rotating wash arms 14 through which washing liquid is distributed by spraying onto dishes within the washing chamber 12.

A float mechanism 15, to be described herein, is shown occupying the front, left hand corner of the bottom wall 16 of the washing chamber 12. It will be understood that other locations could be chosen for the placement of the float mechanism 15 though it is desirable that the mechanism 15 can be readily serviced from the front of the dishwashing apparatus 10.

Figure 2:
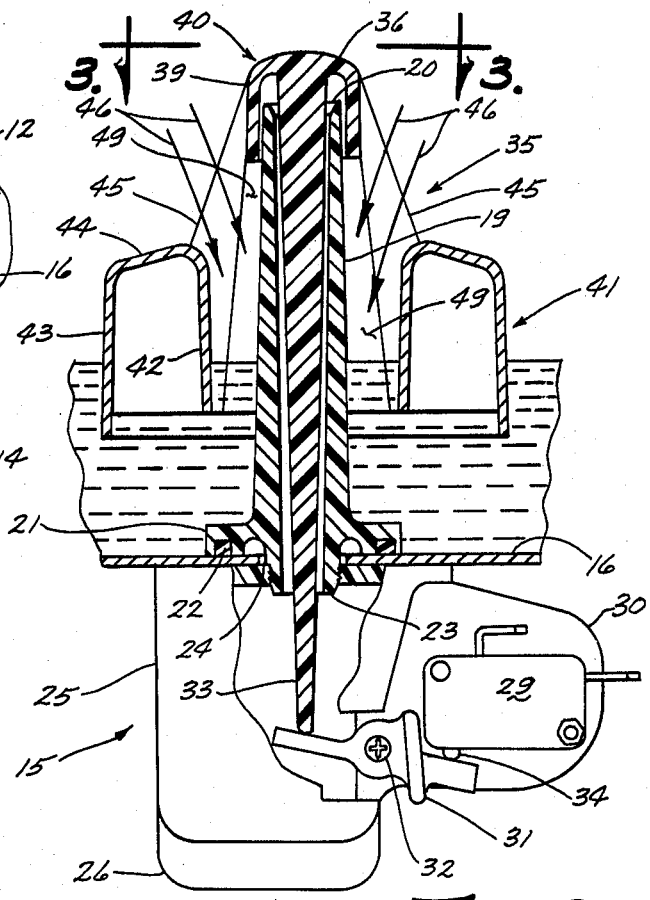
FIG. 2 is a sectional view taken generally along lines 2—2 of FIG. 1 showing the float in a posture for terminating the ingress of liquid into the washing chamber.

Turning now to FIG. 2, the mounting of the float mechanism 15 to the bottom wall 16 of the washing chamber 12 is more specifically shown. A generally cylindrical guide tube or standpipe 19 having an axially extending central aperture 20 extends upwardly from the bottom wall 16 of the washing chamber 12. The standpipe 19 extends upwardly to a point substantially above the maximum permitted liquid level in the washing chamber 12. The lower flanged portion 21 of the standpipe 19 which contacts the bottom wall 16 of the washing chamber 12 is provided with an annular gasket 22 for preventing the leakage of liquid from the washing chamber 12. A threaded lower portion 23 of the standpipe 19 extends below the gasket surface and through an aperture 24 in the bottom wall 16 of the washing chamber 12 for engagement with mating threads in a mounting plate 25 located outside the bottom wall 16 of the washing chamber 12.

The mounting plate 25 includes a downwardly sloping trough-like portion 26 which directs any accidental leakage of washing liquid through the central aperture 20 of the standpipe 19 away from an electrical switch 29 mounted to the plate 25. The electrical switch 29 is mounted, through well-known mechanical fasteners, to a laterally extending generally vertical wall portion 30 of the mounting plate 25.

FIG. 2 further shows an actuating lever 31 pivotally attached to the laterally extending generally vertical wall portion 30 of the mounting plate 25 through a shouldered self-tapping screw or other equivalent fastening means 32 which will allow the actuating lever 31 to freely pivot about its mounting point. The horizontal distance from the point of contact of the float stem 33 with the actuating lever 31 to the mounting point is equal to the horizontal distance from the actuating button 34 of the electrical switch 29 to the mounting point. Thus, the downward force exerted by the weight of the float 35 will substantially equal the upward force exerted by the actuating lever 31 on the actuating button 34 of the electrical switch 29.

The electrical switch 29, as shown in FIG. 2, is connected in series with the electrical solenoid coils of the liquid inlet valve (not shown). The switch contacts are normally open and when the weight of the float 35 forces one end of the actuating lever 31 down, the other end of the actuating lever 31 will hold the switch contacts in the closed position. The posture of the float 35 as shown in FIG 2 indicates a nominal liquid fill of 1-17/64 + or − 3/64 inches measured at the base of the float 35. The float 35, in FIG. 2, has risen by 3/32 of an inch from its at-rest posture which will open the switch contacts and terminate operation of the liquid inlet valve.

Referring again to FIG. 2, the molded thermoplastic float 35 includes a downwardly extending stem portion 33 which extends through the central aperture 20 of the standpipe 19 to contact one end of the actuating lever 31. The uppermost portion of the stem 33 extends radially outward to form a substantially horizontal top wall 36. The top wall 36 terminates in a downwardly extending generally annular wall 39 defining a cap portion 40 which surrounds the outer periphery of the uppermost segment of the standpipe 19. The lower edge of the annular wall 39 of the cap portion 40 is always in a position to cover the open upper end of the standpipe 19 to prevent sprayed liquid from being expelled through the standpipe central aperture 20.

The float 35 also includes, as best shown in FIG. 2, a floatation chamber 41 which is axially spaced down from the cap portion 40 and radially spaced from the standpipe 19. The floatation chamber 41 is formed by inner and outer concentric annular wall members 42 and 43 closed at the top by either a downwardly sloped wall portion 44 as shown in FIG. 2 or radiused as shown in the alternate embodiment of FIG. 4 to insure drainage of liquid therefrom. The floatation chamber 41 thus has an inverted U-shaped cross sectional configuration. The open bottomed floatation chamber 41 traps a pocket of air between the inner and outer wall members 42 and 43 to provide buoyancy to the float 35. While the preferred embodiment of the instant invention has been described in connection with an air bell type of floatation chamber 41, one skilled in the art will appreciate that the invention is not necessarily so limited and that the floatation chamber 41 may take on different shapes and could be a buoyant member such as a foam ring.

Figure 3:
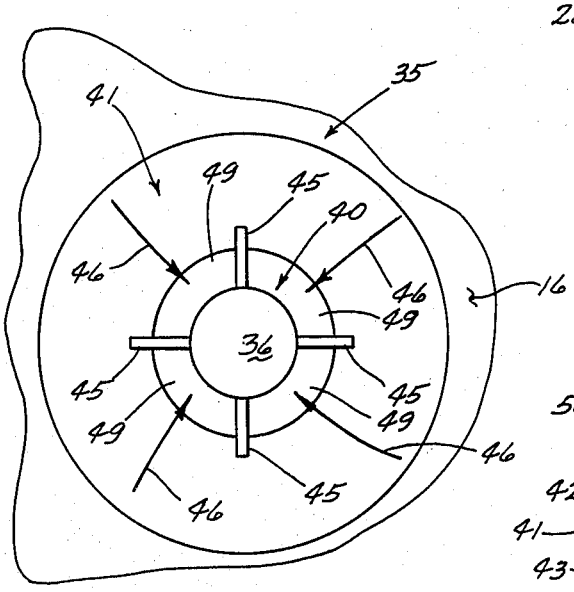
FIG. 3 is a view taken generally along lines 3—3 of FIG. 2 showing the top of the float.

FIGS. 2 and 3 show the cap portion 40 and the floatation chamber 41 connected in an integral fashion through a plurality of arms 45 spaced around the outer periphery of the cap portion 40. The plurality of arms 45 extend downwardly from the cap portion 40 and are connected to the inner wall 42 of the floatation chamber 41.

Figure 4:
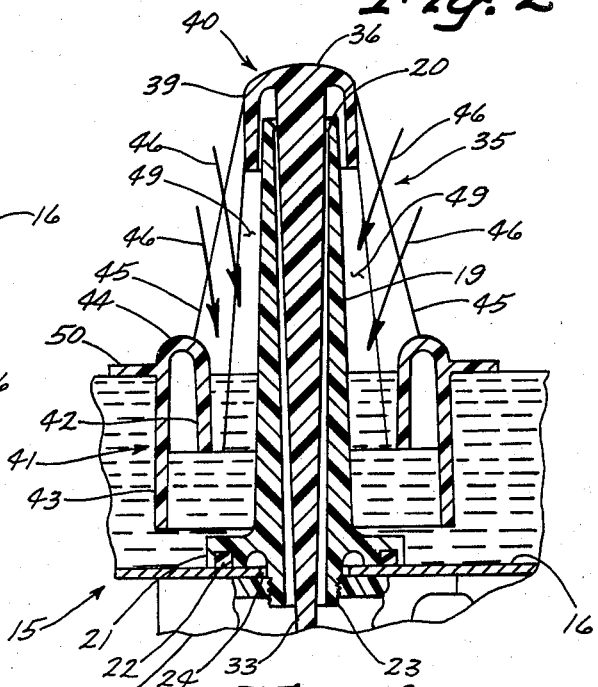
FIG. 4 is a sectional view similar to that of FIG. 2 showing an alternate float embodiment.

The vertically spaced apart relationship of the cap portion 40 and the floatation chamber 41 provides a float 35 which is exposed to the flow of washing liquid into the inner areas adjacent the exterior of the standpipe 19. As the arrows 46 in FIGS. 2–4 show, washing liquid is free to flow through the opening 49 as defined by the axially spaced apart relationship. By flowing into and through the openings 49, the washing liquid cleanses the exterior of the standpipe 19 and the interior of the float 35 to wash away food debris and soap scum that would normally accumulate in this previously relatively quiet area.

FIG. 4 shows an alternate embodiment of the float 35. In FIG. 4, a flat ring 50 is molded to the outside of the floatation chamber 41 at the desired liquid level. This flat ring 50 increases the stability of the float 35 through the surface tension of the washing liquid acting on the ring 50 and through the increase in floatation area.

In operation, as the dishwashing apparatus 10 begins to distribute washing liquid throughout the washing chamber 12, liquid will be displaced in the air, on the dishes and within the wash arms 14. This displacement of washing liquid will lower the liquid level adjacent the float 35 by about $\frac{1}{4}$ inch from the static level shown in FIGS. 2 and 4. The continuous pumping of the liquid will cause a quantity of liquid to flow through the float openings 49 as shown in FIGS. 2–4 and provide the desired cleansing action for the interior of the float 35. When the drain portion of the cycle of operations is initiated, the washing liquid will continue to be pumped through the wash arms 14 until the washing chamber 12 is substantially drained. This continuous flow of washing liquid will provide further cleansing action to the float interior and will tend to remove food particles which previously may have floated on top of the washing liquid.

Opening the access door 13 during the washing portion of the cycle of operations to insert an additional item to be washed permits the washing chamber 12 to fill with relatively cool ambient-temperature air which expands rapidly. Closing the access door 13 confines the air and causes it to try to escape through all openings. The axially spaced apart relationship between the floatation chamber 41 and cap portion 40 of the float 35 provides, in effect, an air gap between the liquid level and the standpipe 19 which will prevent the establishment of a siphon at the standpipe 19 location as the air tries to escape through all openings.

The present construction thus provides an improved float 35 construction providing for self-cleaning of the standpipe 19 exterior and the interior of the float 35. The construction further offers a float 35 which provides an air gap for preventing the establishment of a siphon during rapid pressurization of the washing chamber 12. The construction further provides, in one embodiment, a float 35 having increased stability.

In the drawings and specification, there has been set forth a preferred embodiment of the invention and although specific terms are employed these are used in a generic and descriptive sense only and not for purposes of limitation. Changes in form and the proportion of parts as well as the substitution of equivalents are contemplated as circumstances may suggest or render expedient without departing from the spirit or scope of the invention as further defined in the following claims.

I claim:

1. A liquid level control device for a washing apparatus having a liquid container including a bottom wall and means within said container for spraying liquid, the combination comprising: a standpipe extending generally vertically from said bottom wall and having an open upper end disposed above the liquid operating level and a lower end providing an opening through said bottom wall; liquid supply control means outside said container including actuating means adjacent the lower end of said standpipe; and vertically movable control means operably associated with said standpipe and including a buoyant portion radially spaced from said standpipe, a cap portion axially spaced above said buoyant portion and enclosing the open upper end of said standpipe to prevent entry of spraying liquid thereinto, angularly spaced means for interconnecting said buoyant portion and said cap portion in said axially spaced apart relationship and defining an open area therebetween to permit spraying liquid to flow therethrough, and an elongated stem portion extending downwardly from said cap portion and through said standpipe for engagement with said actuating means.

2. A liquid level control device as defined in claim 1 wherein said angularly spaced means for interconnecting includes a plurality of arms to maintain said axially spaced apart relationship of said buoyant portion and said cap portion.

3. A liquid level control device as defined in claim 1 wherein said open area between said buoyant portion and said cap portion defines an air gap between said buoyant portion and said standpipe.

4. A liquid level control device as defined in claim 1 wherein said buoyant portion includes a secondary substantially flat ring integral with said buoyant portion.

5. A liquid level control device for a dishwashing apparatus having a liquid container including a bottom wall and means within said container for spraying liquid, the combination comprising: a standpipe extending generally vertically from said bottom wall to a location above the operating level of said liquid and communicating with the outside of said container through an axially extending inner aperture; liquid supply control means outside said container and including actuating means adjacent said standpipe aperture; and vertically movable control means operably associated with said standpipe and including a buoyant portion radially spaced from said standpipe, a cap portion axially spaced above said buoyant portion and having a downwardly extending circumferential wall enclosing the upper extremity of said standpipe to prevent entry of spraying liquid into said aperture, a plurality of angularly spaced arms interconnecting said buoyant portion and said cap portion in said axially spaced apart relationship and defining a plurality of openings therebetween to permit spraying liquid to flow therethrough, and an elongated stem portion extending downwardly from said cap portion and through said standpipe aperture for engagement with said actuating means.

6. A liquid control device as defined in claim 5 wherein said buoyant portion includes a floatation chamber defined by annular, generally vertical inner and outer walls joined at their upper ends and open at the bottom.

7. A liquid level control device for a dishwashing apparatus having a liquid container including a bottom wall and means within said container for spraying liquid, the combination comprising: a standpipe extending generally vertically from said bottom wall to a location above the operating level of said liquid and communicating with the outside of said container through an axially extending inner aperture; liquid supply control means outside said container and including actuating means adjacent said standpipe aperture; and a vertically movable float operably associated with said standpipe and including a floatation chamber radially spaced from said standpipe and defined by annular, generally vertical inner and outer walls joined at their upper ends and open at the bottom, an imperforate cap portion axially spaced above said floatation chamber and having a downwardly extending circumferential wall enclosing the upper extremity of said standpipe to prevent entry of spraying liquid into said aperture, a plurality of angularly spaced arms interconnecting said floatation chamber and said cap portion in said axially spaced apart relationship and defining a plurality of openings therebetween to permit spraying liquid to flow therethrough, and an elongated stem portion extending downwardly from said cap portion and through said standpipe aperture for engagement with said actuating means.

8. A liquid control device as defined in claim 7 wherein said floatation chamber includes a secondary substantially flat ring integral with the outer wall of said floatation chamber.

9. A liquid control device as defined in claim 7 wherein said openings define an air gap between said standpipe and said floatation chamber.

* * * * *